United States Patent [19]

Davoud et al.

[11] 4,055,951

[45] Nov. 1, 1977

[54] CONDENSING VAPOR HEAT ENGINE WITH TWO-PHASE COMPRESSION AND CONSTANT VOLUME SUPERHEATING

[75] Inventors: John Gordon Davoud; Jerry Allen Burke, Jr., both of Richmond, Va.

[73] Assignee: D-Cycle Associates, Richmond, Va.

[21] Appl. No.: 714,513

[22] Filed: Aug. 16, 1976

[51] Int. Cl.[2] ..... F01K 21/02

[52] U.S. Cl. ..... 60/514

[58] Field of Search ..... 60/508–515, 60/516, 670, 721

[56] References Cited

U.S. PATENT DOCUMENTS

| | | | |
|---|---|---|---|
| 883,866 | 4/1908 | Dean | 60/514 |
| 1,636,887 | 7/1927 | Windell | 60/514 |
| 2,867,975 | 1/1959 | Mallory | 60/514 |
| 3,905,195 | 9/1975 | Gregory | 60/512 |

FOREIGN PATENT DOCUMENTS

| | | | |
|---|---|---|---|
| 243,903 | 2/1947 | Switzerland | 60/670 |

*Primary Examiner*—Allen M. Ostrager
*Attorney, Agent, or Firm*—Harold L. Stowell

[57] ABSTRACT

A heat-power engine and system using a condensable vapor as the working fluid has a cylinder with a piston operating therein characterized in that the heat input communicates with the swept volume of the engine in a zone comprising the clearance volume of the cylinder at the top dead center of the piston.

9 Claims, 7 Drawing Figures

CONDENSING VAPOR HEAT ENGINE WITH TWO-PHASE COMPRESSION AND CONSTANT VOLUME SUPERHEATING

CROSS-REFERENCES TO RELATED PATENTS

Related subject matter is disclosed and claimed in related U.S. Pat. Nos. 3,716,990 to J. G. Davoud: 3,772,883, to J. G. Davoud and J. A. Burke, Jr.; 3,798,908 to J. G. Davoud and J. A. Burke, Jr.; and application Ser. No. 714,501 filed even date herewith entitled "Condensing Vapor Heat Engine with Constant Volume Heating and Evaporating" to J. A. Burke and J. G. Davoud

BACKGROUND OF THE INVENTION

Reciprocating engines using a condensable vapor, usually steam, and with or without condensers, have been known and widely used for about two hundred years. For most of this period, a low inherent thermal efficiency was the price paid for relatively mild steam conditions, that is, low temperature and low pressure.

These mild steam conditions were for a long period dictated by the boiler for the condensable vapor. The fire tube boiler was simple, sturdy, and easy to operate and it is still in wide use. Even today, however, a fire tube boiler is limited to maximum pressures of about 250 psig. and much lower pressures are often used. The fire tube boiler can be used with a superheater, but the majority of reciprocating steam engines in use, until the virtual eclipse of the genre in the twentieth century, made use of saturated steam at pressures below 250 psig. These steam conditions allowed the use of simple inlet valves, reasonably effective under the conditions used, having a variety of designs such as slide valves, piston valves, and poppet valves, and a simple lubrication system.

A further feature of this prior art type of steam engine which also bought simplicity at the expense of efficiency, was a relatively small expansion ratio of steam and, in many cases, none at all. This simplified valve design and allowed easy inlet valve intervals.

The net result was an engine which was simple, sturdy, long lived, and required no exotic or unusual construction materials or techniques; however, the price paid was low efficiency.

In recent years, a considerable effort has been made to develop condensing steam reciprocating engines with much higher efficiencies. A natural approach, with predictable theoretical results, but still within the confines of the Rankine condensing cycle, has been to use much higher temperatures, pressures, and expansion ratios. Steam conditions at inlet of 1000° F with pressures from 1000 to 3000 psia, and pressure ratios in expansion of 25 to 1, have been employed. New techniques and improved materials have been used and great progress has been made in rapid and efficient steam generation through the use of improved monotube type boiler-superheaters.

Another approach to obtain higher efficiency has been to alter the basic Rankine cycle. U.S. Pat. Nos. 3,798,908; 3,716,990 and 3,772,883 teach a condensing vapor cycle in which maximum operating pressure is attained by mechanical compression of wet vapor, i.e. two phase compression. This cycle shows significantly higher ideal efficiency than the Rankine cycle with identical vapor conditions at inlet and exhaust. This improved cycle has relatively high temperature as a basic requirement in order to show worth-while improvement over the Rankine cycle.

All these improved engine types, requiring high inlet temperatures and pressures, and very short inlet valve intervals, make heavy demands on both mechanical features and metallurgy. As expected, they show predictably higher efficiency than condensing engines operating with saturated steam at lower pressures. Very recent developments in steam engines for automotive use now show that even these improved efficiencies may be insufficient for modern vehicular use. Further projections based on still higher temperatures, pressures, and expansion ratios are now under consideration. Inlet temperatures of 1500° F and pressures of 3000 psig are predicted with overall pressure ratios of 80 in the expansion process, requiring a compound engine with reheat. These conditions will require new frontiers in inlet valve material and mechanical design.

The net result is that the provision of suitable inlet valving sets one constraint on the reciprocating condensing vapor engine based on either the Rankine or the steam compression cycles. Another constraint is set by the requirement of upper cylinder lubrication. Rankine engines operating at steam inlet temperatures of 1000° F have been shown to be capable of prolonged operation with monotube boilers using hydrocarbon-based oils for upper cylinder lubrication but it is extremely unlikely that this method will suffice at 1500° F, much less at even higher temperatures.

A third constraint is economic—the high cost in strategic materials such as nickel and chromium required in monotube boiler-superheaters and reheaters operating at such elevated temperatures and pressures.

A way to obviate these problems is through the use of a condensing vapor engine using a modification of the Stirling cycle. This method is disclosed and claimed in U.S. Pat. application Ser. No. 596,165 filed July 15, 1975 now U.S. Pat. No. 3,996,745. This cycle makes use of the cooling effect of two-phase vapor compression as taught in U.S. Pat. Nos. 3,798,908; 3,772,889 and 3,772,883. Lubrication and piston sealing in the engine are similar to methods developed for high pressure Stirling engines using gaseous working fluids such as hydrogen and helium. In engines of this type, the piston is sealed by plastic rings at the bottom of a long cylinder, so designed that the ring always operates in a relatively cool portion of the cylinder, while the hot space of the cylinder and the top of the piston can be at very high temperatures in excess of 1500° F. Such engines, of the so-called Rinia type, with interconnected hot and cold spaces, have no inlet valves at all; require no lubricants and in both the gaseous and condensing vapor type are mechanically simple as regards valve requirements.

The gaseous Stirling engine has neither inlet nor outlet valves in the normal mode of operation; while the condensing vapor type has an outlet valve for passing part of the condensable vapor to the condenser, and an injector for injecting condensate into the so-called cool space during compression. These are easy operations both as regards mechanical features and metallurgical requirements.

A negative feature of the Stirling cycle is the need to cycle the working substance in the gaseous state between hot and cold spaces in the engine. The combined effect of gaseous viscosity and inertia is to reduce the efficiency of the cycle when it is operating at maximum power, i.e. at maximum pressure, as the usual way to alter power output in such engines is to alter the pressure of the working substance.

A further practical problem in the Stirling engine, whether based on gaseous or condensable vapor working substance is design and fabrication of the heater elements between the hot and cold spaces of the engine. To date, no satisfactory compromise has been effected between material cost, engine efficiency, and the requirements of mass production.

Present practice is to use a tube bundle. The material of construction is generally high temperature alloy steel. Metallurgical requirements place a constraint on temperature, and the shape and configuration of the tubes places a further constraint on mass production methods.

Ceramics and cermets, however satisfactory for continuous high temperature operation in an oxidizing flame, pose difficult problems of fabrication.

SUMMARY OF THE INVENTION

The present invention may be defined as a heat-power engine and system using a condensable vapor as the working fluid having a cylinder with a piston operating therein characterized in that the heat input communicates with the swept volume of the engine in a zone comprising the clearance volume of the cylinder at the top dead center of the piston.

It is a primary object of the present invention to provide a condensing vapor engine which greatly reduces or eliminates altogether the problems described above which are peculiar to external combustion engines of the Rankine and Stirling types, and the vapor compression cycle with orthodox inlet valving.

The overall result is a condensable vapor engine of notable mechanical simplicity, capable of operating at the extremely high temperature necessary to achieve high thermodynamic efficiency and thereby providing a new engine attractive against such good performers as the diesel engine.

DESCRIPTION OF PREFERRED EMBODIMENTS

Figure 1:
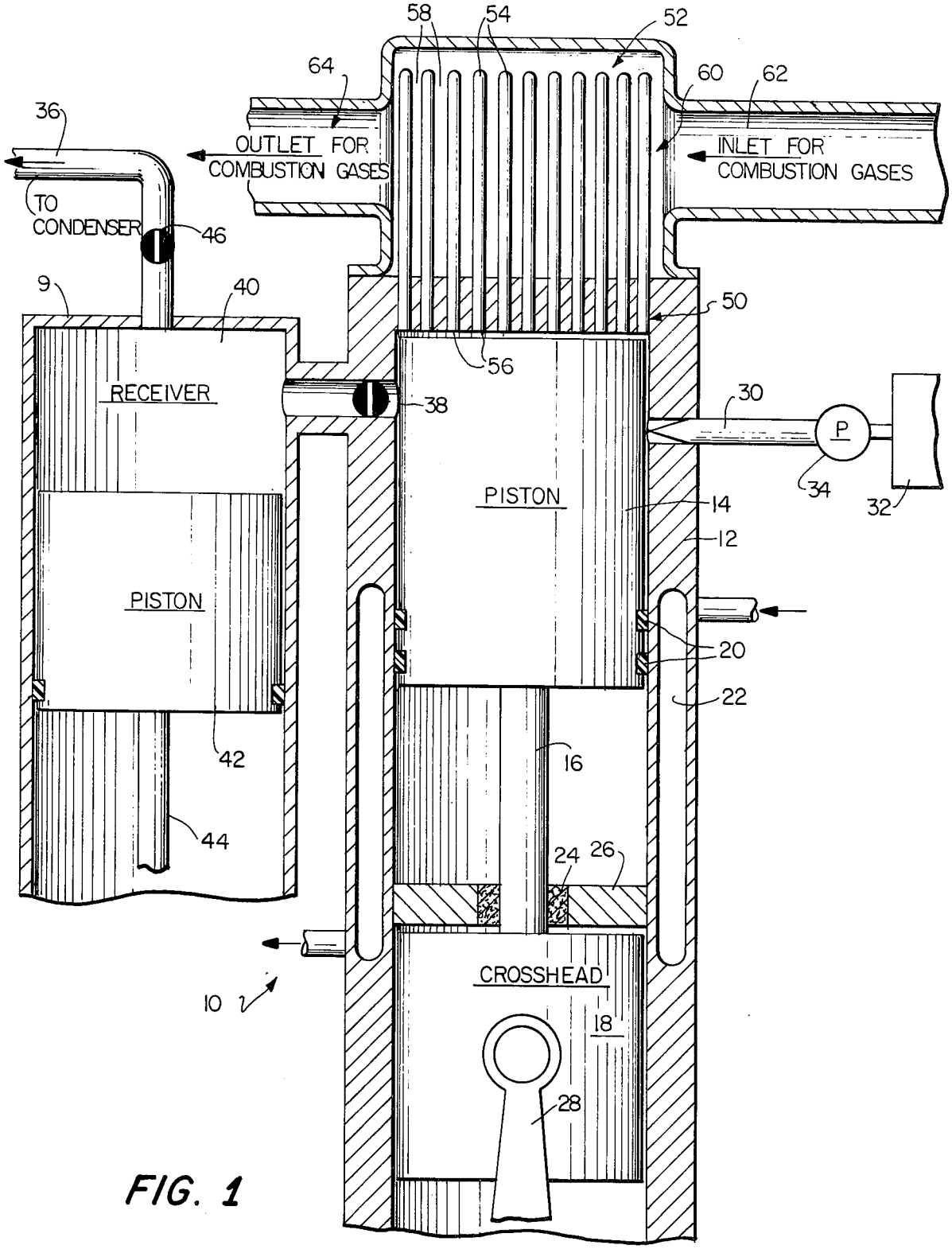
FIG. 1 is a fragmentary, diagrammatic, partial sectional view of an engine embodying the principles of the present invention.

Referring particularly to FIG. 1 of the drawing, 10 generally designates an engine embodying the principles of the present invention. The engine includes a cylinder 12 within which a piston 14 having a rod 16 and a crosshead 18 reciprocates. The piston 14 is provided with sealing rings 20 at the lower end thereof, which piston rings may comprise plastic bands as the rings always reciprocate in a zone of the cylinder 12 surrounded by a cooling liquid chamber 22.

The diagrammatic showing does not illustrate means for conveying a cooling liquid to and from the chamber 22, but such means may be of conventional construction. The rod 16 of the piston 14 which is connected to the upper end of the crosshead 18 passes through an oil seal or packing 24 carried by a cylindrical transverse partition 26. The crosshead carries a crank arm 28 connected to a conventional crank shaft (not shown).

In the upper portion of the cylinder wall there is provided a liquid injector 30, which injector 30 is connected to a source of condensed condensable liquid 32 and a pump 34. The source 32 of liquid may be from a condenser (not shown), which condenser is connected to conduit 36 to be described hereinafter. Also, in the upper end of the cylinder is a mechanically operated valve means 38 of, for example, the rotary type or the poppet type. The valve 38 connects a receiver zone 40 with the upper cylinder zone. The receiver is provided with a piston 42 having a rod 44, which rod is, for example, connected to the crank shaft for the crank arm 28 or to a supplemental crank driven via timing gears.

The receiver 40 is provided with an outlet 36 to the condenser (not shown) via a mechanically operated valve means 46. The valves 46 and 38 are operated via timing means which may be of the variable type so that control of the engine may be selectively manual or automatic.

The means so described will insure the removal of a fixed proportion of steam from the cylinder 12 at the end of expansion, the extent of which is determined by the ratio of the swept volume of the receiver zone 40 to the swept volume and clearance volume of the power cylinder 12; and which will be unchanged by condensing pressure.

A second means to remove a controllable amount of steam at the end of each expansion stroke is to provide the steam receiver 40 with a variable volume. In this case, the piston 38 would not reciprocate, but be moved manually via rod 44 to give the volume required in the receiver.

Using this means of removing a proportion of steam from cylinder 12, in the normal operating mode, at the end of expansion exhaust valve 38 opens, while valve 46 is closed. A portion of the steam in cylinder 12 is passed to receiver 40. The ratio of the weight of steam passed to receiver 40 to the weight retained in cylinder 12 is determined by:

1. The relative volume of the receiver 40 and the cylinder 12 plus the clearance space.
2. The condensing pressure and temperature.
3. The pressure at the end of expansion.

For a given set of steam conditions at end of expansion, and a given condensing temperature and pressure, the volume of the receiver can be adjusted to remove any desired portion of steam from cylinder 12.

A third way of removing a fixed portion of steam from cylinder 12 is the method taught in reference U.S. Pat. No. 3,798,908, shown diagrammatically in FIG. 11.

The entire cylinder head portion generally designated 50 of the cylinder 12 is formed as novel heater tube means 52 forming a portion of the present invention. The heater tubes comprise a plurality of thin-wall tubes 54 opened at their lower ends 56 to the volume of the cylinder 12 and therefore communicate with the swept volume of the cylinder.

The tubes 54 have spaces 58 therebetween such communicate with the heater gases which may comprise combustion gases from an external combustor. The combustion gases enter a chamber generally designated 60 via inlet conduit 62 and exit from the chamber 60 via outlet conduit 64. Since the gases exiting via conduit 64 may be at very high temperatures, the outlet conduit 64 is preferably connected to a regenerative heat exchanger or the like before being exhausted to the atmosphere.

In this arrangement, the hot gases issuing from the combuster impinge directly onto the closed ends of the heater tubes and pass outward through the tube bundle hence to an exhaust passage which can lead, as indicated herein, to a air heat exchanger for heating incoming combustion air.

The heat exchanger 62 can be made of metal, such as nickel-iron, or other high temperature alloy. The form of the heat exchanger is particularly suitable for construction from ceramic materials such as silicon nitride, or cermets, which have extremely useful properties as heat exchangers for combustion gases. Silicon nitride, for example, has outstanding chemical resistance, stability in oxidizing flame, resistance to extreme thermal shock, and strength retention at extremely high temperatures, in excess of 2,000° F. While in the form of the invention illustrated in FIG. 1 the heat input comprises combustion gases from an externally fired combustor, other heat input arrangements can be used with either liquid or condensing vapor as the heat exchange media instead of direct heating by hot gaseous products of combustion as taught, for example in U.S. Pat. application Ser. No. 596,165.

Figure 2:
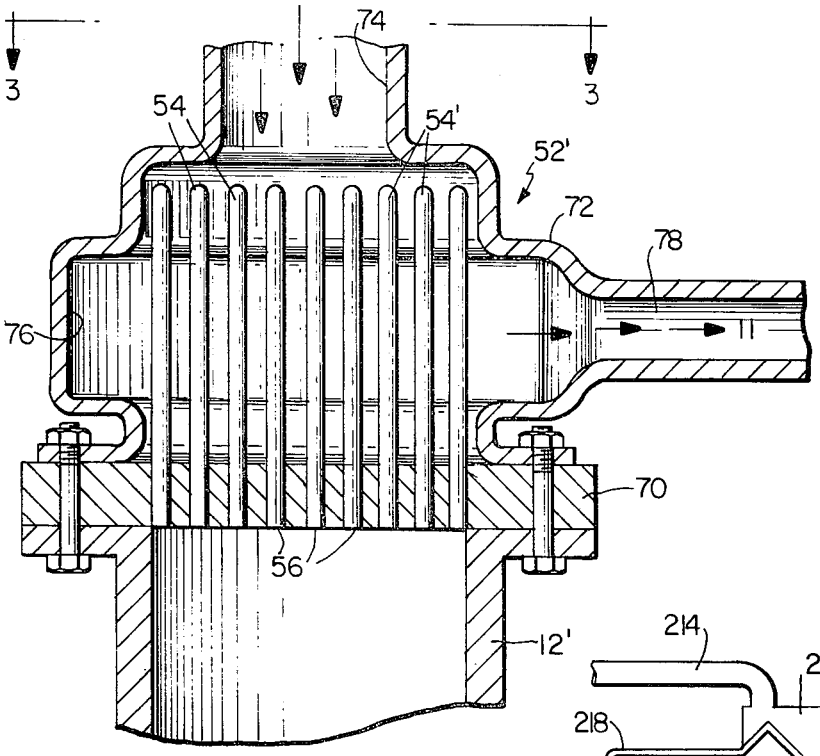
FIG. 2 is a diagrammatic fragmentary sectional view through a heat exchanger of a modified configuration.
Figure 3:
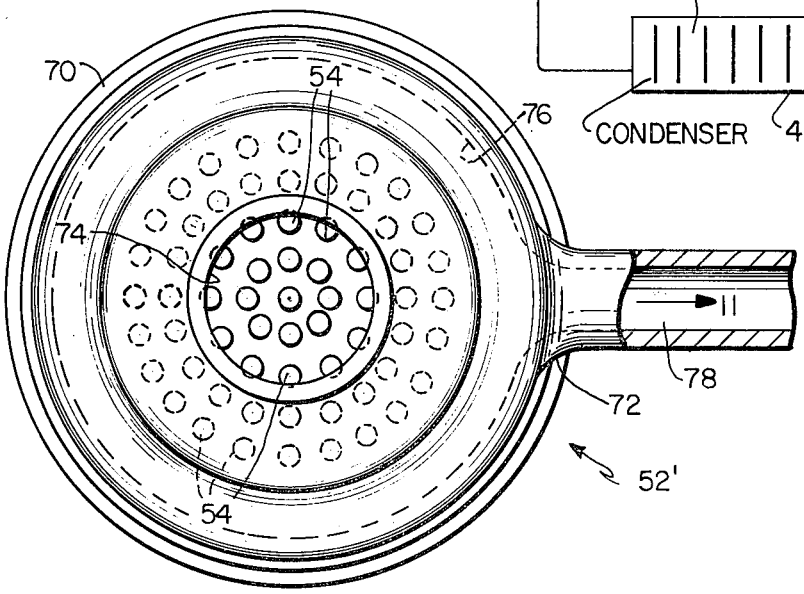
FIG. 3 is a section on line 3—3 of FIG. 2.

Referring now to FIGS. 2 and 3 showing an alternate arrangement for directing hot gaseous products of combustion about the heater tubes 54, 12' generally designates the upper end of the power cylinder which has secured thereto a head 70 containing the heater tubes 54 closed at their upper ends 54' and open at their lower ends as at 56 into the swept volume of the cylinder 12'. The heater tubes 54 are surrounded by a manifold 72 having an upper inlet end 74 having connection to a source of hot gaseous products of combustion. In this arrangement, the hot gaseous products impinge directly upon the closed ends of the heater tubes 54', flow about the tubes, pass outwards through the tube bundle and into a circumferential collecting ring 76 thence to an exhaust passage 78, which exhaust passage can lead to an air heat exchanger for heating incoming combustion air as previously described. The header 70 and the tubes 54 may be of unitary construction particularly where the heat exchanger is formed of ceramic material.

Figure 5:
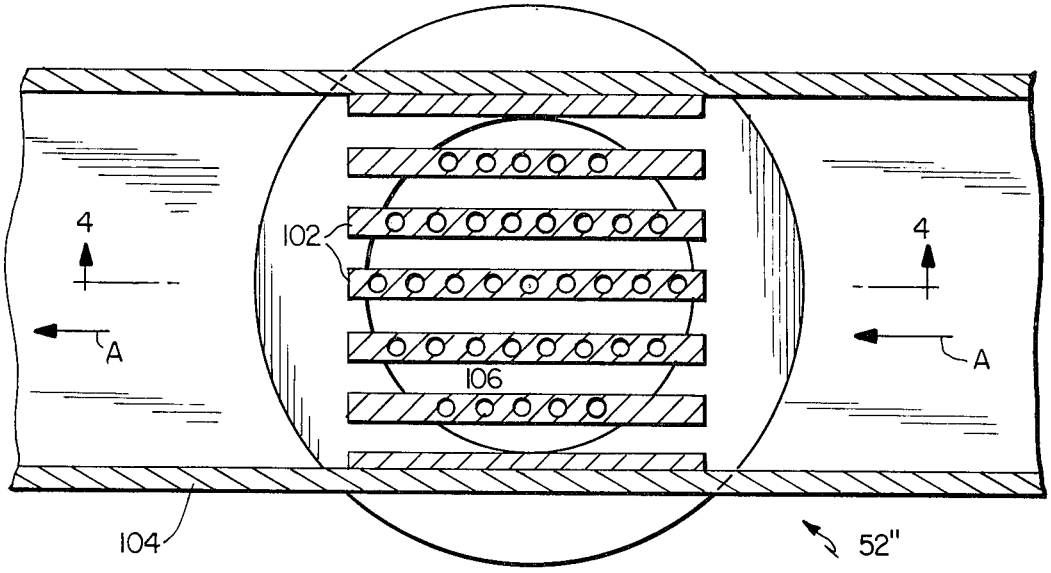
FIG. 5 is a section on line 5—5 of FIG. 4.
Figure 4:
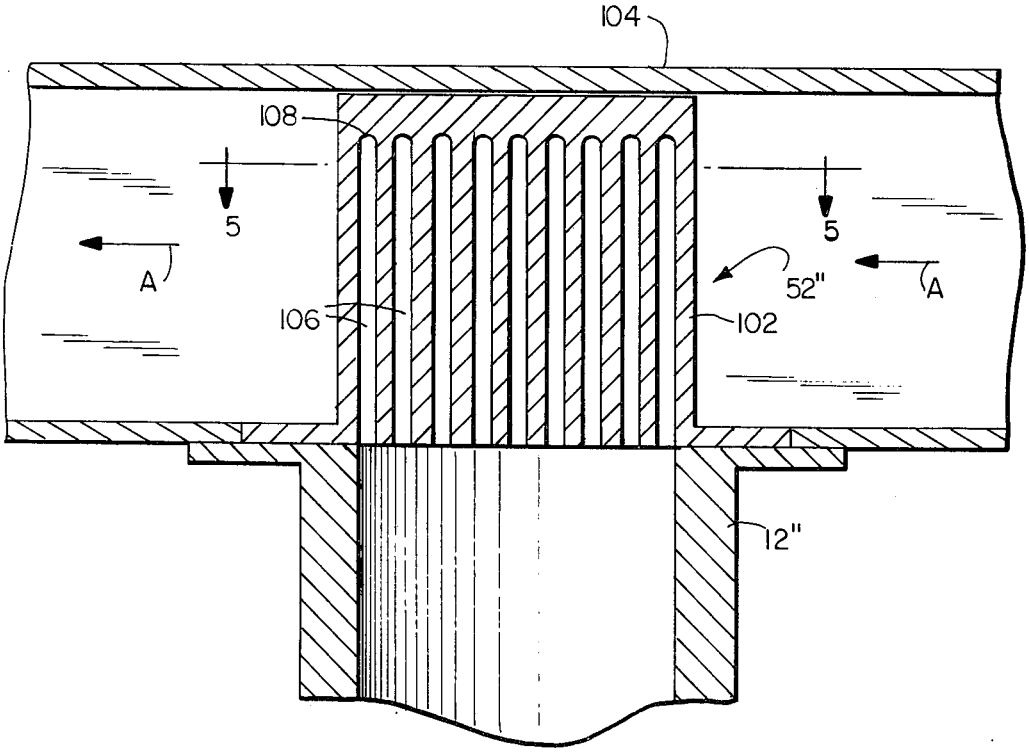
FIG. 4 is a view like FIG. 2 of a further modified form of the present invention on line 4—4 of FIG. 5.

Referring now to FIGS. 4 and 5 illutrating a modified form of heat exchanger 52'', the heat exchanger is attached to the upper end of the engine's cylinder 12'' and the heat exchanger is basically quandrangular in plan and composed of a plurality of spaced, parallel plates 102 aligned such that the passages between the plates are parallel to the direction of combustion gas flow in the header 104 as shown by direction arrows A in FIGS. 4 and 5.

Each of the spaced, parallel plates 102 is bored or formed with openings 106 therein in the zone of the bore of the cylinder 12''. The openings or bores 106 communicate with the volume of the cylinder 12'' at their lower ends and are closed at their upper ends 108. This form of construction lends itself to conventional ceramic manufacturing techniques.

Figure 6:
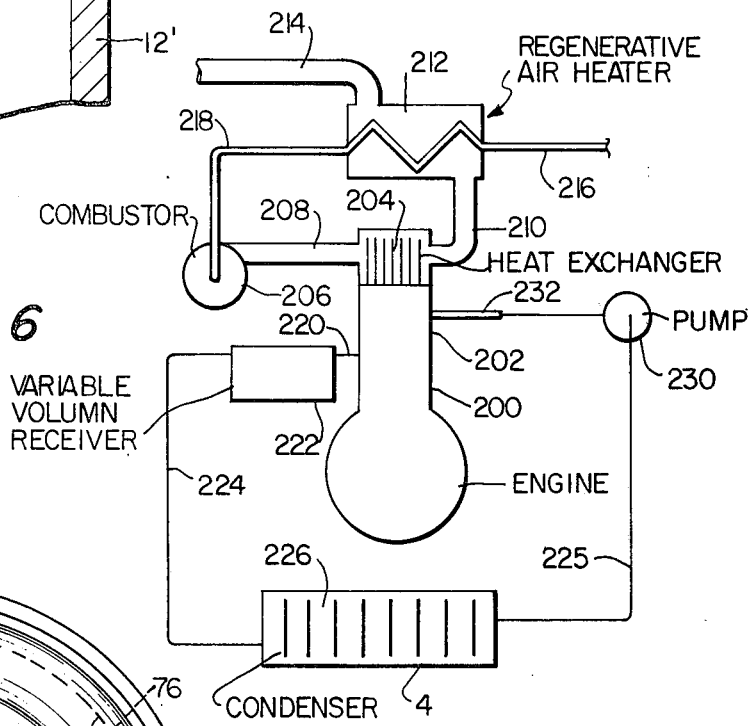
FIG. 6 is a diagrammatic view of a further modified form of the present invention.

Referring now to FIG. 6, a block diagram of a power system using an engine such as shown in FIG. 1, there is illustrated an engine 200 having a cylinder 202 provided with a heat exchanger 204 which may be of the type shown in FIGS. 1, 2, and 3 or 4 and 5. The heat exchanger is provided with combustion gases from combustor 206 via the conduit 208. The hot gases exhausting from the heat exchanger 204 are directed by conduit 210 to a regenerative air heater 212. The combustion gases leave the regenerative air heater 212 via an exhaust pipe 214. Air is fed to the regenerative heat exchanger 212 via conduit 216 and from the regenerative air heater the heated combustion air is directed to combustor 206 via conduit 218.

Valved conduit 220 connects the cylinder zone of the engine 200 with a variable volume receiver 222 which may be of the type illustrated in FIG. 1 of the drawings. Withdrawn gaseous working fluid is directed from the variable volume receiver via conduit 224 to the condenser 226. Condensed fluid from the condenser 226 is directed by conduit 228 to high pressure pump 230 thence to injector 232 for injection at the proper sequence into the upper portion of cylinder 202.

The method of operation of the engine shown in FIG. 6 is as follows. In normal use, when the engine has been stopped, the cylinder and clearance space (the internal volume of the heater tubes) will contain steam under pressure. When the engine cools, the pressure will fall; the steam will ultimately condense.

To re-start the engine, the sequence of operation is (1) to light the combustor (2) and then motor the engine with a starter (not shown). This will also run the engine-driven injector pump, and water will be injected into the cylinder.

The normal heat of compression vaporizes some water, and steam is then generated in the heater tubes, after which the engine shortly becomes self-sustaining.

OPERATION

In the normal operating mode, at the end of expansion exhaust valve 38 (FIG. 1) opens, while valve 46 is closed. A portion of the steam in the cylinder 12 is passed to the receiver 40 (FIG. 1) or 222 (FIG. 6). The ratio of the weight of steam passed to the receiver to the weight retained in the cylinder is determined by:

1. The relative volume of the receiver and the cylinder plus clearance space.
2. The condensing pressure and temperature.
3. The pressure at the end of expansion.

For a given set of steam conditions at end of expansion and condensing temperature and pressure, the volume of the receiver can be adjusted to remove any desired portion of steam from cylinder 1.

By way of illustration, a normal operating mode of the power system is described in which the method of stream extraction is the second of the three earlier described.

At the start of the up-stroke of the engine's piston, the valve 38 closes. Valve 46 opens, allowing pressure in receiver 40 or 222 to fall to condenser pressure. During the up-stroke of the pistion 14, the weight equivalent of the steam removed from cylinder 12 or 202 is injected as a fine spray of water into the cylinder 12 or 202. This lowers the entropy and enthalpy of the steam in the cylinder, and also lowers the work of compression.

All the compressed steam will have passed into the heater tubes at top dead center at which point the heat transfer rate will be greatly increased because of the high steam pressure. Superheating to high temperature takes place virtually at constant volume. The high pressure superheated steam in the heater tubes expands doing work against the piston on the down stroke. At the end of expansion, the cycle repeats.

To alter the power of the engine, the maximum pressure in the cylinder 12 or 202 is changed upwards or downwards by injecting more or less water. This will change all the cycle state points correspondingly.

Since the engine has high combustion gas exhaust temperature, the usual way to handle this situation is to use a regenerative air heater, as shown in FIG. 6 at 212.

Figure 7:
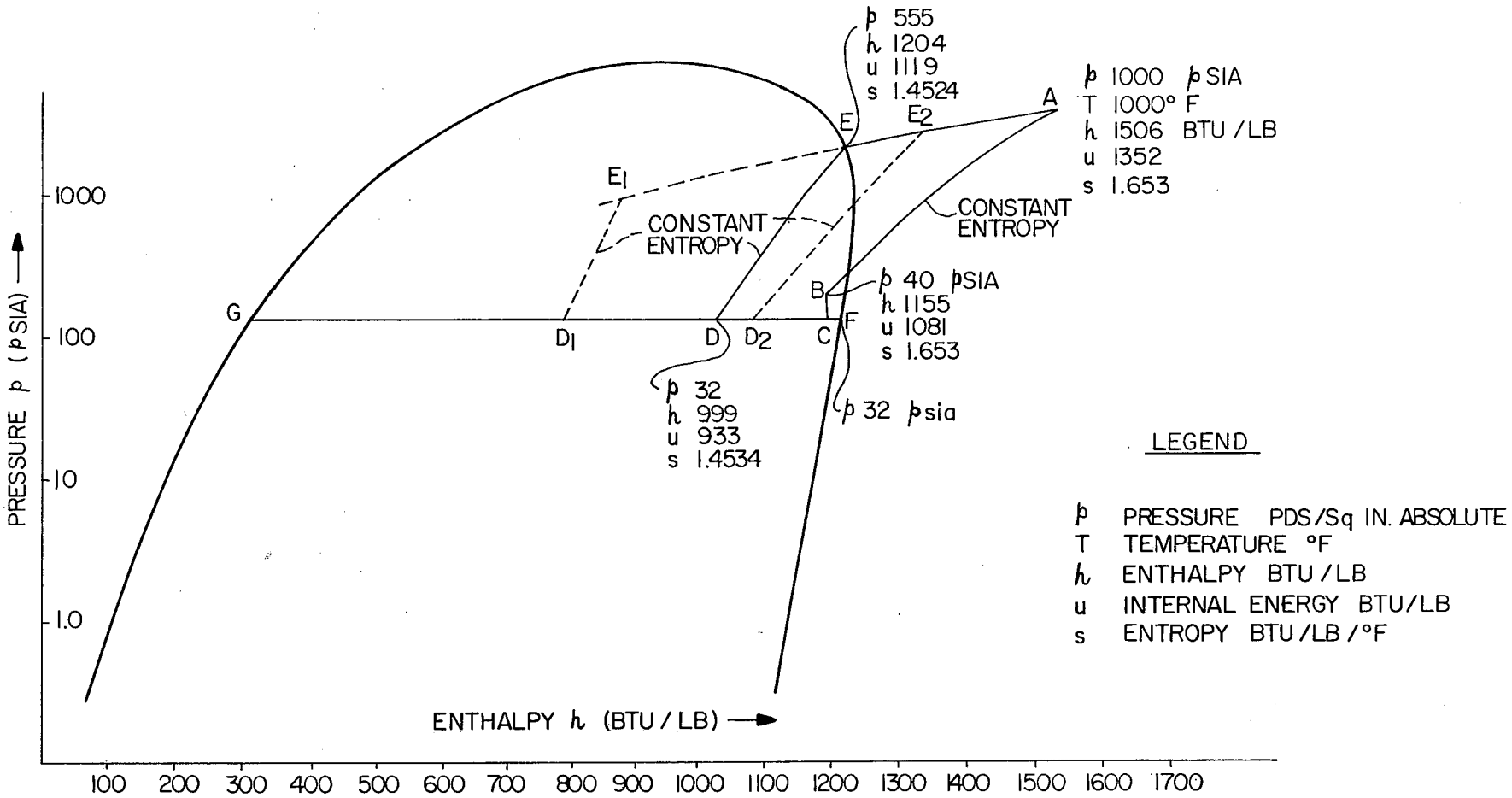
FIG. 7 is a water-steam phase diagram on pressure-enthalpy coordinates, defining steam state points corresponding to the operation of a cycle embodying the principles of the present invention.

Referring now to FIG. 7, ideal state-points, of the working fluid, correspond to the cycle described.

Point A is the state point (maximum temperature and pressure) when the piston 14 (FIG. 1) is at top dead center and all the steam is in the heater tubes.

AB is an ideal isentropic expansion. There will be heat input throughout the expansion. The practical result will be thermodynamically, expansion somewhere between isentropic and isothermal; and the work out will be somewhat greater than shown.

At point B, the valve 38 (FIG. 1) opens, and the pressure falls as shown to point C. A portion of the steam is thereby removed from cylinder 12. The ratio of $$\frac{\text{weight steam removed to receiver}}{\text{weight steam remaining in cylinder}} = \frac{\text{length } DF}{\text{length } GD}$$

After valve 38 (FIG. 1) is closed, the weight equivalent of the steam removed is injected into the remainder producing wet steam of state point D.

Line D – E shows the ideal isentropic compression of wet steam of composition shown at D.

Compression continues to point E. Point E lies on the line of constant volume which passes through point A; point A being the state-point of the steam in the clearance volume, i.e. in the heater tubes 54 of FIG. 1 after input of heat. At top dead center, the steam having state-point at E has been passed into the heater tubes. E – A correspondents to the input of heat into the steam at constant volume.

As shown, the maximum pressure of compression is much less than the maximum pressure at the end of heat absorption by the steam in the heater tubes. The advantage of this configuration is to reduce work of compression.

The state points of FIG. 7 are for an ideal engine. In actual fact, the expansion, as shown above, will not be truly isentropic because of continuous heat input to part of the steam throughout the entire work of expansion. Similarly, there will be heat input to some of the steam throughout compression and the work of compression will also be greater than indicated by the diagram. This somewhat parallels the state changes in the Stirling cycle where some of the expansion takes place in the so-called "cold" space and part of the compression takes place in the "hot" space. However, as in the Stirling engine, the net effect is that the overall work of expansion significantly exceeds the work of compression, and the engine is a net producer of mechanical work.

Although the fact of continuous absorption of heat, just as in the Stirling cycle, complicates the mathematical treatment of an actual engine, a reasonable approximation of the efficiency of this type of heat engine can be obtained by assuming ideal isentropic expansion and compression, and constant volume heat input as shown in FIG. 7.

The expression for the thermodynamic efficiency of the cycle with state-points A–B–C–D–E–A of FIG. 7 is $$\text{Efficiency} = \frac{\text{Work of Expansion - Work of Compression}}{\text{Heat Absorbed by Working Substance}}$$

Work of expansion is (Internal energy at A – Internal energy at B) or $u_A - u_B$ Work of compression is (Internal energy at E – Internal energy at D) or $u_E - u_D$ Heat absorbed at constant volume is (Internal energy at A – Internal energy at E) or $u_A - u_E$ Using the numerical values of $u_A$, $u_B$, $u_D$, $u_E$ shown in FIG. 7, Work of expansion $u_A - u_B = (1352 - 1081) = 271$ BTU/lb.

Work of compression $u_E - u_D = (1119 - 933) = 186$ BTU/lb.

Heat absorbed at constant volume – $u_A - u_E = 1352 - 1119 - 233$ BTU/lb.

$$\text{Efficiency} = \frac{271 - 186}{233} = 0.364 \text{ or } 36.4\%$$

The cycle described arithmetically above shows compression DE, with the point E lying on the saturated vapor line. It may also be operated by compressing steam of lower quality, ending the mechanical compression with wet steam $D_1 E_1$, or compression into the superheated region could be used, $D_2 E_2$. In either case, the state-point of the steam at the end of compression but before heat absorption would lie on the line of constant volume $E_1 E E_2 A$ which passes through the state-point A, which defines the state of the steam after absorption of heat.

Having thus described the improved engine, and shown an example of the order of efficiency to be expected therefrom, I claim:

1. A heat engine power producing cycle using a condensable vapor as the working fluid characterized in that the heat input is indirectly into the working fluid of the engine in a zone comprising the clearance volume of the cylinder and wherein the working fluid is introduced into the swept volume of the cylinder of the engine as a fine spray of liquid.

2. A power producing cycle as defined in claim 1 in which a portion of the working fluid is removed from the cylinder zone at the end of each expansion stroke.

3. A power producing cycle as defined in claim 2 in which removal of a portion of the working fluid from the cylinder swept volume is through a mechanically operated valve.

4. A power producing cycle as defined in claim 3 wherein the portion of the working fluid removed from the swept volume of the cylinder of the engine is condensed.

5. A power producing cycle as defined in claim 3 in which the weight equivalent of the working fluid removed at the end of expansion is injected into the swept volume of the cylinder on the up-stroke of the piston thereof.

6. A power producing cycle as defined in claim 1 in which the heat input to the engine corresponds to constant volume heating and superheating.

7. A power producing cycle as defined in claim 1 in which the heat passing to the working fluid is through the wall of the clearance volume of the working cylinder.

8. A heat engine as defined in claim 1 further characterized in that the working fluid is heated in a tube bundle the open ends of which are in continuous direct communication with the cylinder zone.

9. The invention defined in claim 8 wherein the tube bundle comprises a block, a plurality of transverse passages in said block for passage of hot gaseous combustion products, and a plurality of openings in said block which passages are in direct communication with the cylinder zone and form the clearance volume of the cylinder.

* * * * *